US007721723B2

(12) United States Patent
Long

(10) Patent No.: US 7,721,723 B2
(45) Date of Patent: May 25, 2010

(54) VALVE ASSEMBLY FOR PAINTBALL GUNS AND THE LIKE, AND IMPROVED GUNS INCORPORATING THE ASSEMBLY

(76) Inventor: Robert M. Long, 1799 Carpenter Rd., Oakley, Contra Costa, CA (US) 94561

( * ) Notice: Subject to any disclaimer, the term of this patent is extended or adjusted under 35 U.S.C. 154(b) by 0 days.

(21) Appl. No.: 12/426,959

(22) Filed: Apr. 21, 2009

(65) Prior Publication Data

US 2009/0199832 A1 Aug. 13, 2009

Related U.S. Application Data

(62) Division of application No. 11/552,131, filed on Oct. 23, 2006, now Pat. No. 7,520,275.

(60) Provisional application No. 60/729,814, filed on Oct. 22, 2005, provisional application No. 60/762,969, filed on Jan. 26, 2006.

(51) Int. Cl.
*F41B 11/00* (2006.01)

(52) U.S. Cl. ..... 124/73; 124/75

(58) Field of Classification Search ..... 124/73–77
See application file for complete search history.

(56) References Cited

U.S. PATENT DOCUMENTS 5,505,188 A * 4/1996 Williams ..... 124/74
5,613,483 A * 3/1997 Lukas et al. ..... 124/73
6,810,871 B2 * 11/2004 Jones ..... 124/77
7,044,119 B2 * 5/2006 Jones ..... 124/74
7,299,796 B2 * 11/2007 Kirwan ..... 124/71
7,395,819 B2 * 7/2008 Dobbins et al. ..... 124/71
2004/0255923 A1 * 12/2004 Carnall et al. ..... 124/73
2006/0011186 A1 * 1/2006 Jones et al. ..... 124/73
2007/0215134 A1 * 9/2007 DeHaan et al. ..... 124/77

* cited by examiner

*Primary Examiner*—Troy Chambers
*Assistant Examiner*—Gabriel J Klein
(74) *Attorney, Agent, or Firm*—Albert W. Watkins

(57) ABSTRACT

A gun preferably designed to rapidly fire paint balls includes a single valve assembly that is inserted into and removed from the gun body. The valve assembly includes a low pressure ram passing through a longitudinal center or core of the assembly, and is capable of being driven in opposite reciprocal directions. A volumizer stores a charge of high pressure gas sufficient to adequately propel a paint ball, and a high pressure poppet valve is driven by movement of the low pressure ram for releasing the charge rapidly. A bolt carried upon the low pressure ram moves a paint ball into firing position just prior to the high pressure discharge. All of the aforementioned components of the cartridge are carried upon a single axis defined by the ram. Means are provided to both align and couple the various components together to ensure proper operation at high firing rates.

4 Claims, 6 Drawing Sheets

VALVE ASSEMBLY FOR PAINTBALL GUNS AND THE LIKE, AND IMPROVED GUNS INCORPORATING THE ASSEMBLY

CROSS REFERENCE TO RELATED APPLICATIONS

This application is a divisional application of U.S. patent application Ser. No. 11/552,131 filed Oct. 23, 2006 and granted as U.S. Pat. No. 7,520,275 on Apr. 21, 2009, which in turn claims priority to U.S. provisional patent application Ser. No. 60/729,814 filed Oct. 22, 2005 entitled "Pneumatic Sleeve, Hammer and Valve Assembly for Paintball Guns and the Like, and Improved Guns Incorporating the Assembly" naming the present inventor, and to U.S. provisional patent application Ser. No. 60/762,969 filed Jan. 26, 2006 also entitled "Pneumatic Sleeve, Hammer and Valve Assembly for Paintball Guns and the Like, and Improved Guns Incorporating the Assembly" and naming the present inventor, the contents of each which are incorporated herein by reference in entirety.

BACKGROUND OF THE INVENTION

1. Field of the Invention

This invention pertains generally to the field of mechanical guns and projectors, and more particularly to fluid pressure propulsion, with control for discharge of fluid pressure provided by a valve. In a preferred embodiment, the present invention is manifested in a single-axis bolt and valve assembly used within a paintball marker.

2. Description of the Related Art

Fluid pressure propulsion has been used in combination with various types of guns and projectors for many years. As an alternative to gun powder and other explosive substances, various pump guns existed which allowed an operator to pump air into a chamber until sufficient fluid was compressed to attain the necessary pressure to reasonably fire a projectile. Many BB and pellet guns were sold for many years that utilized this technology. These guns, while fully functional and capable of firing projectiles at great speeds, suffered from many significant drawbacks. Foremost among these was the inability to keep the gun in a ready-to-fire state, commonly due to slow leakage through the pumping mechanisms, and the delay time between firing successive shots, necessitated by the need to pump another charge of air into the pressure chamber after each shot. In addition, having been designed to resemble the gun powder versions, they were often rather large and heavy. While weight reduces recoil in gun powder versions, it is of lesser importance in the less powerful pump guns.

As an alternative to and improvement over the pump-pressure guns, various gas and liquified gas cylinders were provided to deliver a steady source of fluid pressure to the gun. Exemplary of these were the $CO_2$ cartridges which were small and lightweight, but which provided a very limited number of successive firings before requiring replacement. To fire these guns, various mechanical triggering devices were used to control the actuation of a valve. Common valves required a substantial amount of time to activate and reset, which in view of the relatively small number of shots available was not normally considered a limitation for these guns.

A number of years ago, a new gun was developed which would fire small capsules or balls of paint that were frangible, and so would break relatively easily upon impact. By filling the frangible exterior shell with liquid paint, it was possible to visually determine whether a participant had been "hit". Consequently, the guns are commonly referred to as markers, since rather than inflicting harm or death, a paintball gun marks the point of impact. The early markers made it possible to conduct relatively close-range training drills for military and civilian training, without the need for other types of complex, expensive and unreliable training weapons or the fear of serious harm that would be associated with more traditional guns.

Many developments have occurred over the years that have evolved the early paintball guns into the more modern counterparts. These developments have occurred in all aspects, affecting not only the technology of firing and propulsion, but also in areas separate and distinct from the guns, such as safety and in the formal organization of teams and competitions. In a comparatively few recent years, the development has progressed and evolved into both a science and industry of its own. As a sport, paintball has been identified as the third largest participant sport in the United States with millions of participants, has substantial numbers of participants and competitions the world over, and continues to grow in popularity both in numbers of participants and in spectators.

One area of development which has and continues to be very challenging to gun designers is the firing rate of a gun. To be most effective, a modern paintball gun will preferably be capable of firing paint balls at rates not measured in balls per second, but instead in the tens of balls per second. More rapid firing rates permit the balls to be distributed through lesser angles of an arc, in the event the gun is being moved while being fired. Since movement and motion are inseparable from paintball, the higher firing rate translates into a greater likelihood of marking an opponent. This can be readily contrasted with the pneumatic guns outside of the paintball industry, where firing rates are more commonly measured in seconds per shot or in only a few shots per second.

Another demanding area of development is the size and weight of the gun. While size and weight are often interrelated in most products since a larger product of otherwise identical construction will weigh more, in the case of a paintball gun the size and weight bring about different benefits and so are somewhat independent. With regard to weight, the gun must be held and moved about. At times, such as when surprised by an opponent, the gun will most desirably redirected in as little time as possible. Lower weight guns can be moved about more quickly, and may further be aimed in less time. With regard to size, the gun will sometimes be held out beyond the shelter of a barrier, exposing only the gun and not the person. The smaller a gun, the more difficult it will be to be marked by an opponent.

Additional areas that have required much consideration and development have included the reliability of successfully firing the gun, and the ease of cleaning out the gun when a paint ball is broken within the gun. When a paint ball breaks within the gun, a way must be provided to remove the components since paint will be smeared or splashed about inside the gun, and without cleaning, will increasingly interfere with proper operation. The more readily the components along the path of the ball are removed, the easier and quicker it will be for a participant to recover from a broken ball. Nevertheless, the precision of components and operation must still be maintained, or there will be many more balls breaking.

SUMMARY OF THE INVENTION

Exemplary embodiments of the present invention solve inadequacies of the prior art by providing a single cartridge that is inserted into and removed from a gun body. The cartridge includes a low pressure ram capable of being driven in opposite reciprocal directions, a volumizer for storing a charge of high pressure gas sufficient to adequately propel a paint ball, a high pressure valve driven by movement of the low pressure ram for releasing the charge rapidly, and a bolt carried upon the low pressure ram for moving a paint ball into firing position just prior to the high pressure discharge. All of the aforementioned components of the cartridge are carried upon a single axis, through which the low pressure ram passes. Means are provided to both align and couple the various components together to ensure proper operation at high firing rates.

As described in a first manifestation, the invention is a valve assembly for paintball guns and the like. The valve assembly has an end cap, a low-pressure ram chamber having at least two ports spaced distally from each other and each operative to allow gas to pass through, and a ram having a ram head and O-ring dividing the low-pressure ram chamber into a first and a second low-pressure enclosure. The first low-pressure enclosure is in communication with a first one of the at least two ports and the second low-pressure enclosure is in communication with a second one of the at least two ports, the first port isolated from the second port. A bolt is coupled for relative movement with the ram and has at least one hole penetrating longitudinally through the bolt, and a plurality of seals cooperative with a gun barrel and feed neck to seal the feed neck from a blast of high pressure gas during gun firing. A volumizer has a high pressure inlet to a volumizer enclosure, and at least one flow port coupling an exterior of the volumizer to the at least one hole penetrating through the bolt. A high pressure valve controls flow from the volumizer enclosure to flow port. Each of the end cap, low-pressure ram chamber, ram, bolt, volumizer and valve are constrained within the valve assembly such that the valve assembly remains a single integrated unit not only during normal operation but also during removal from and insertion into a gun body.

In a second manifestation, the invention is a paintball gun. The gun has a feed neck for receiving paint balls into a breech from an external source. A barrel coupler couples the gun to a gun barrel. A source of high pressure gas is coupled to the gun for distribution within the gun. A human interface is provided for manual initiation gun firing. A gun body has a bore therein in line with the barrel coupler. A valve assembly is held within the bore in the gun body, and has an end cap, ram, low-pressure ram chamber, volumizer, valve, and bolt, the ram extending from adjacent the end cap to the bolt and coupled with the valve to activate the valve when the ram is driven away from the end cap.

In a third manifestation, the invention is a method of firing a projectile from a hand-held gun having a gun barrel. According to the method, low pressure gas is delivered into an enclosed chamber of variable volume. A ram defining the variable volume is driven responsive to the low pressure gas delivery. A paint ball is advanced from a breech into a firing position within the hand-held gun body responsive to the driving step. A high pressure valve is activated responsive to the driving step and subsequent to the advancing step. High-pressure gas which has been stored within an enclosure is released in a rapid burst responsive to the activating step, and is then conducted to the paint ball and down the gun barrel.

OBJECTS OF THE INVENTION

A first object of the invention is to provide a paintball gun which will preferably be capable of firing paint balls at rates measured in the tens of balls per second. A second object of the invention is to lower the size and weight of the gun relative to the prior art. Another object of the present invention is to improve the reliability of successfully firing the gun, and also simultaneously ease gun cleaning when a paint ball is broken within the gun.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
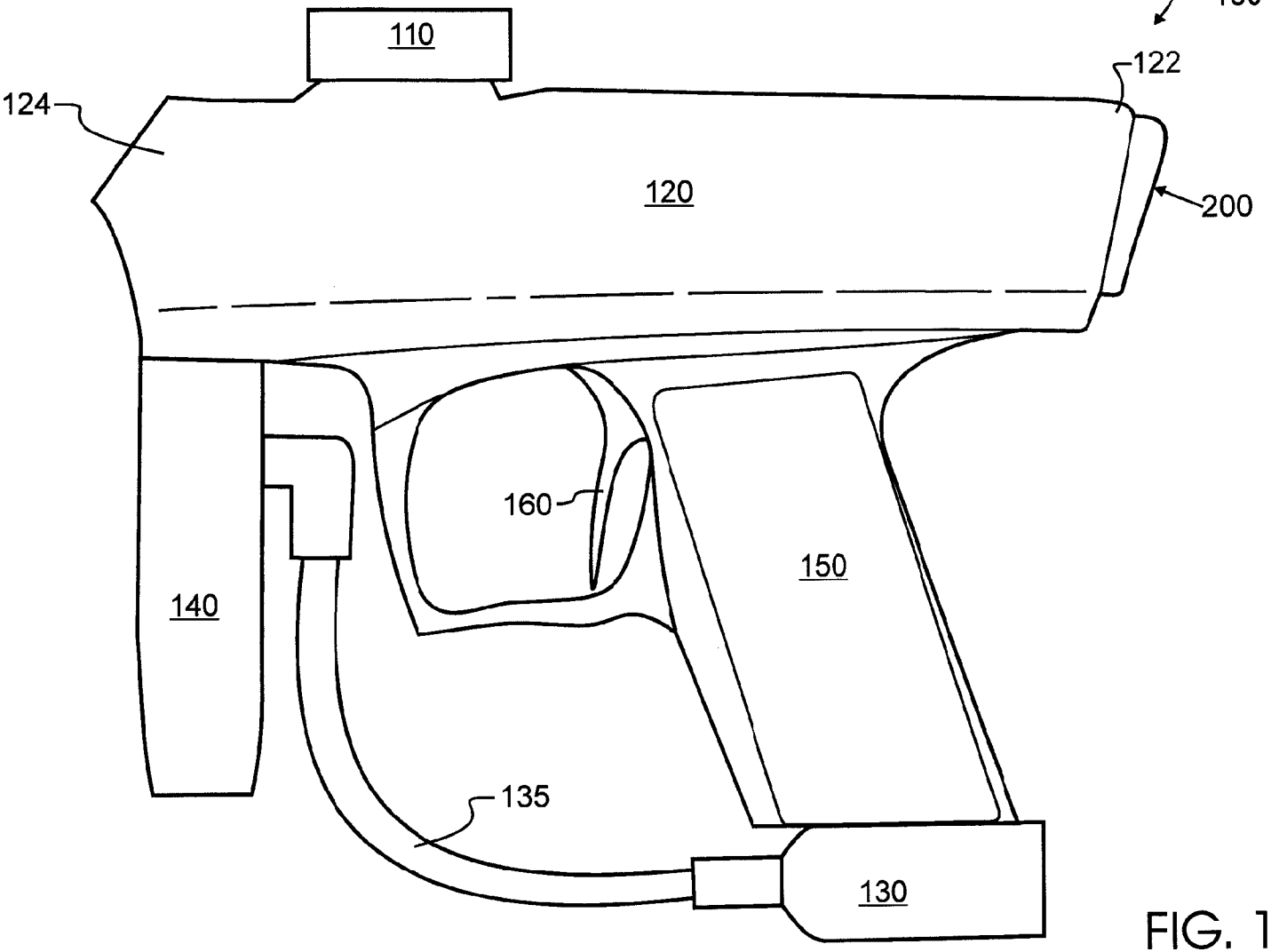
FIG. 1 illustrates a paintball gun incorporating the present invention from side plan view with the barrel, magazine and gas cartridge removed.

A paintball gun 100, also referred to as a paintball marker, is shown by an external side plan view in FIG. 1. As illustrated therein, a feed neck 110 is provided for introducing paint balls into gun 100. The source of paint balls is not consequential to the present invention, but may be a magazine such as a hopper, a powered ball feeder, or other device known in the art to provide a high speed, high volume source of paint balls. The paint balls will pass from feed neck 110 into gun body 120, where they will rest in the breech. From there, the balls will be moved forward, and then fired, or violently expelled by a high-pressure blast, through barrel coupler 124 and out a gun barrel as is known in the art. A high pressure gas canister is coupled, either directly or indirectly, through coupler 130. High pressure gas will pass from coupler 130 through hose 135 and into pressure regulator 140 for distribution into gun body 120. A handle 150 and trigger 160 provide the human interface with gun 100 for holding the gun and initiating firing, and handle 150 will often house a battery and electronic controls that may be used with modern paintball guns.

Adjacent the end 122 of gun body 120, distal to barrel coupler 124, is the very end of valve assembly 200. Valve assembly 200 is held within a bore in gun body 120 in line with a gun barrel longitudinal axis. This valve assembly 200 is designed to slide into and out from the bore as a single unit, which permits rapid removal for cleaning and repairs. Furthermore, since the bore within gun body 120 is along a single axis and in line with the barrel, both inspection and cleaning are simplified.

Figure 2:
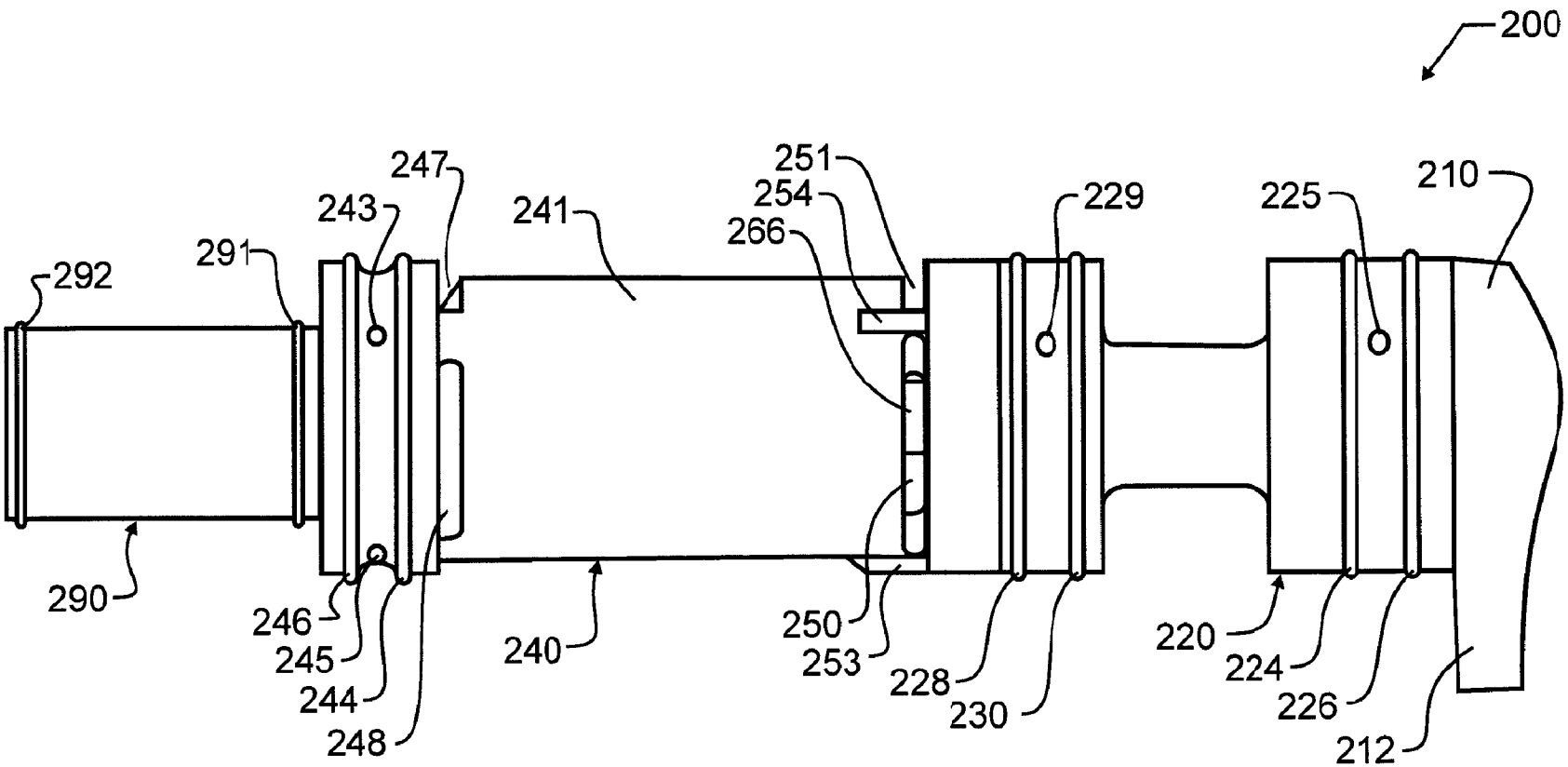
FIG. 2 illustrates a preferred embodiment valve assembly designed in accord with the teachings of the present invention and operative with the preferred embodiment gun of FIG. 1, from a side plan view and in a stationary but ready-to-be-fired position.

The preferred embodiment valve assembly 200 is illustrated in FIG. 2 removed from gun body 120, but oriented as it would be in FIG. 1. Consequently, in FIG. 1 the only component of valve assembly 200 which is visible is a portion of end cap 210, including locking and alignment wing 212. Valve assembly 200 has several primary components in addition to end cap 210. These include the low-pressure ram chamber 220, volumizer 240, and bolt 290. Each of these components is constrained within valve assembly 200, such that valve assembly 200 remains a single integrated unit not only during normal operation but also during removal from and insertion into gun body 120.

In operation, at the start of a firing sequence low pressure gas is delivered into port 225, and simultaneously exhausted from port 229. The gas will preferably be introduced through small ports or openings within gun body 120 or other suitable tube concentric about valve assembly 200. The ports that deliver the pressurized gas do not have to align with ports 225 and 229, but instead must fall between the adjacent O-ring seals. O-rings 224 and 226 will then trap and constrain the flow of pressurized gas with respect to port 225 and O-rings 228, 230 trap and constrain the flow of pressurized gas with respect to port 229, such that the gas can only flow into or from ports 225 and 229 and not be dispersed or intermingled.

Figure 4:
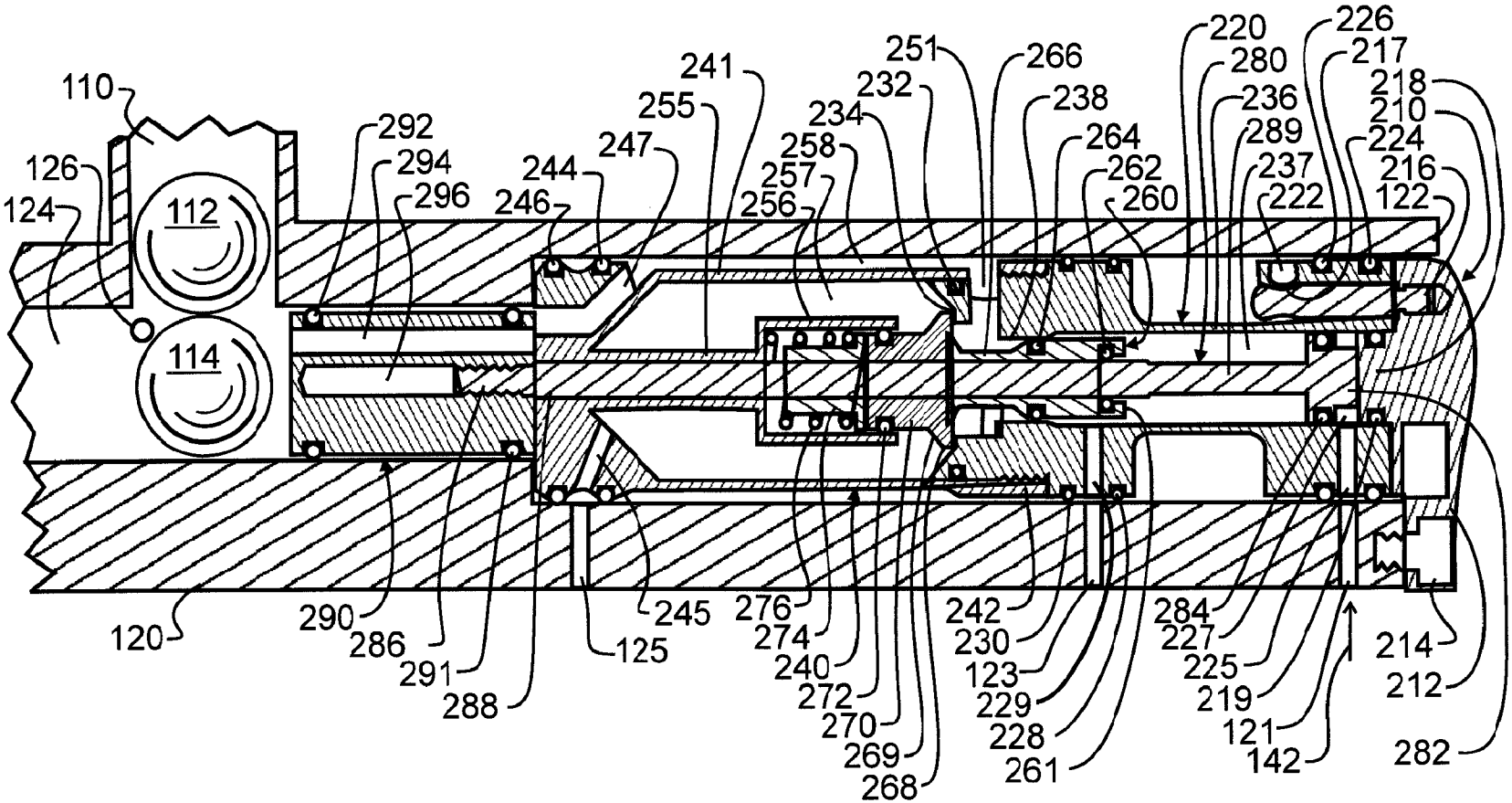
FIG. 4 illustrates the preferred embodiment valve assembly of FIG. 2 from a sectional view taken along section line 4' of FIG. 3, which corresponds to a plane parallel to the page in FIG. 2.
Figure 5:
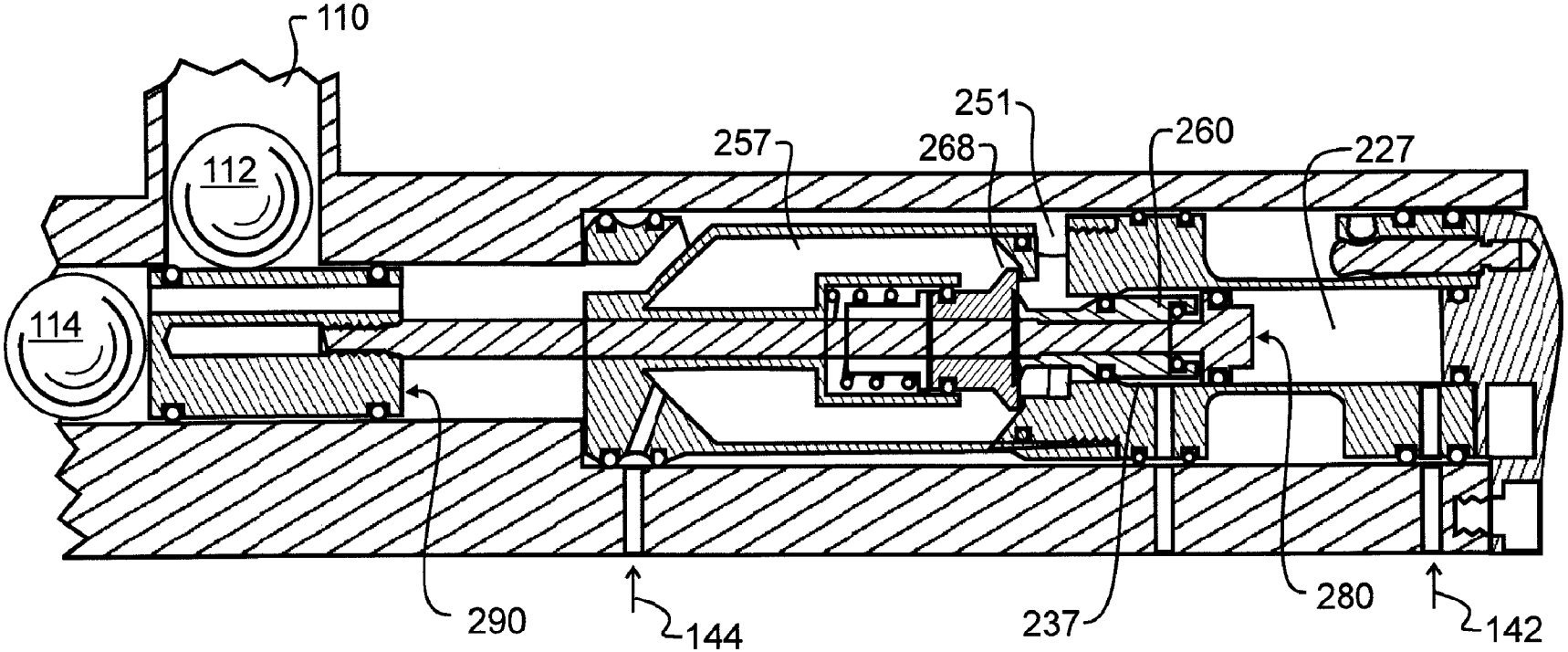
FIG. 5 illustrates the preferred embodiment valve assembly of FIG. 4 in a position immediately prior to high pressure discharge.
Figure 6:
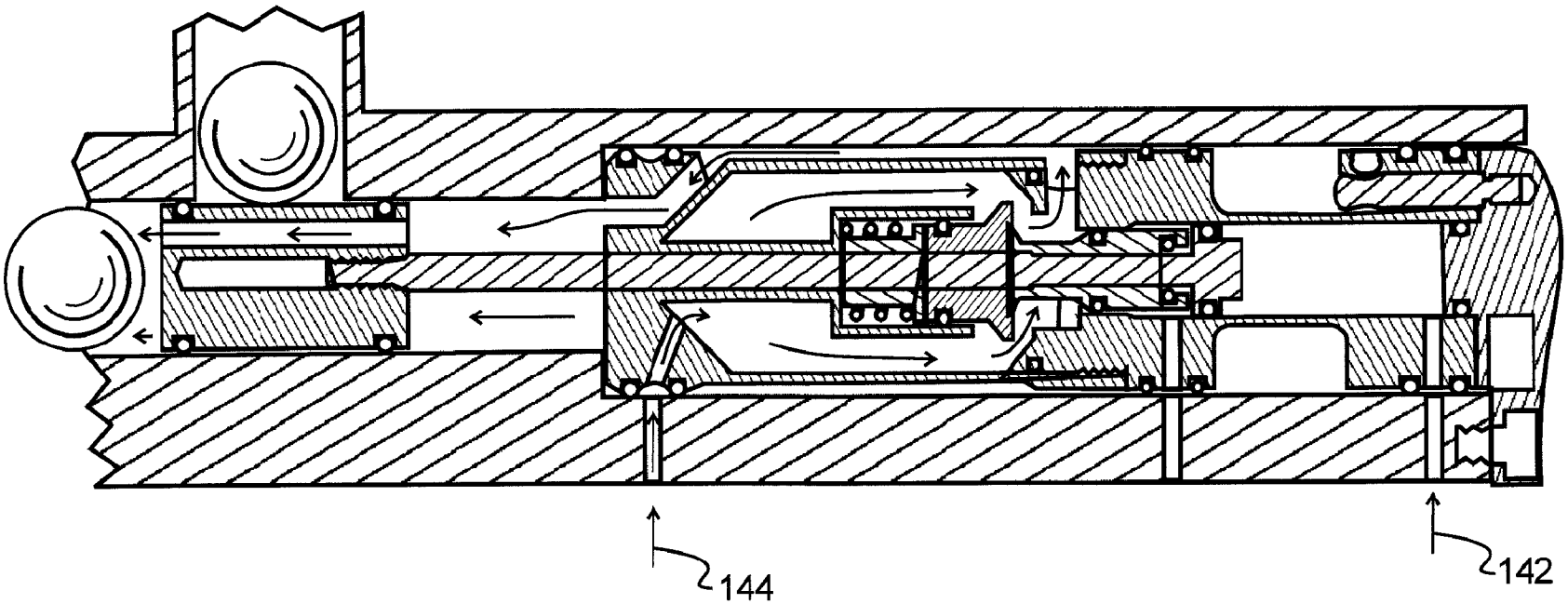
FIG. 6 illustrates the preferred embodiment valve assembly of FIG. 4 in a position during firing, at the time of high pressure discharge, and illustrating the flow of high pressure gas through the assembly.

Flow into port 225 and exhaust from port 229, the control of which is preferably but not mandatory provided by at least one electrically controlled valve, causes a low pressure ram (280 visible in FIGS. 4-6) to travel, and ultimately activate a high pressure valve (poppet valve 260, visible in FIGS. 4-6). Tied directly to the low pressure ram 280 is bolt 290, which means bolt 290 will advance a paint ball 114 from the breech into a firing position within gun body 120. Once the low pressure ram 280 has traveled sufficiently far to set the position of bolt 290, a small additional motion will trigger the actuation of high pressure valve 260 within volumizer 240. This in turn will release high-pressure gas which has been stored within volumizer 240 in a rapid burst, from where it will pass ultimately through bolt 290 and down the barrel. High pressure gas is admitted into volumizer 240 through one or more ports such as 243, 245. Isolating the ports 243 and 245 are O-rings 244 and 246. The O-rings 291, 292 found on bolt 290 serve to seal feed neck 110 from the blast of high pressure gas during firing, so that balls such as ball 112 within feed neck 110 are not blown away from gun body 120 or out of feed neck 110. The remaining features numbered within FIG. 2 pertain to volumizer 240, the operation and construction which will be better explained herein below with reference to FIG. 4.

Figure 3:
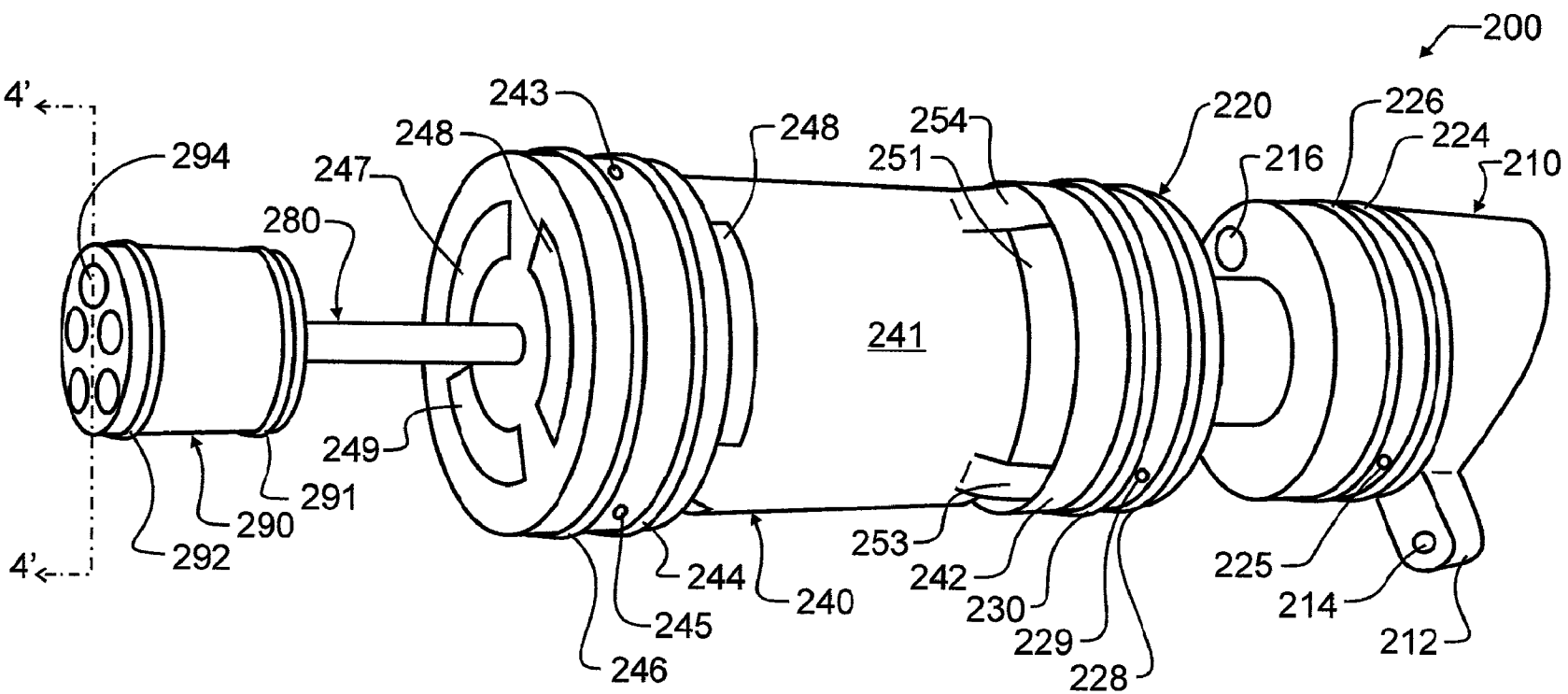
FIG. 3 illustrates the preferred embodiment valve assembly of FIG. 2 from a projected plan view and in a during-firing position.

FIG. 3 illustrates valve assembly 200 from a projected view. This projected view, the side plan view FIG. 2, and the sectional views of FIGS. 4-6 will be described together, with only limited reference to any specific figures. As already described with regard to FIG. 2, an isolated low-pressure system drives a low-pressure ram 280, which in turn moves the sliding shaft and activates poppet valve 260. More specifically, end cap 210 has a small protrusion 218 which, in combination with O-ring 219, low pressure valve body 236, ram head 282 and O-ring 284, forms a variable volume low pressure enclosure 227. As low-pressure gas is introduced into enclosure 227 through ports 121 and 225, as illustrated by flow arrow 142 in FIG. 4, the volume of enclosure 227 will increase by driving ram head 282 farther from protrusion 218 in end cap 210. Ram 280 is directly coupled to bolt 290, thereby moving bolt 290 towards the position illustrated in FIG. 5. While not illustrated and the exact apparatus and method which are not consequential to the present invention, those skilled in the art will understand and recognize the myriad ways of coupling the output of a low-pressure regulator to port 121, such as through an electric valve to a hose coupled into port 121. The coupling which connects the hose into port 121 will commonly take the form of a small tube threaded at one end for screwing into port 121, and barbed at the other to permit a hose to be slid thereon and not easily removed therefrom, though the particular means of coupling of pressurized gas is not critical to the performance of the present invention so long as the gas is in fact provided in a reliable manner.

While the volume of enclosure 227 is increasing, the volume of enclosure 237 is decreasing. In order to permit enclosure 237 to decrease in volume without increasing in pressure, gas retained therein is most preferably vented through an electrically controlled valve or the like to atmosphere. This arrangement has only a few limiting factors to how quickly ram 280 may be moved. A first limiting factor is how quickly the low pressure gas can be introduced into enclosure 227. This is limited or in some instances controlled by the pressure of the low pressure gas at the ports 121, 225, and the cross-sectional area and any flow restrictions in ports 121 and 225 and any other consequential flow restrictions between these ports and the source of low pressure gas. The preferred embodiment has no consequential flow restrictions between the ports and low pressure source, since the only items between the ports and gas tank are pressure regulators, which inherently only maintain pressure and thereby provide no consequential flow restriction, and the electric valve and hoses. The valve and hoses should be large enough to permit operation of ram 280 at any rate desired.

At any time, reversal of ram travel is achieved by applying gas from the low pressure source through ports 123, 229, which pass through and into the interior of low-pressure housing 220 in enclosure 237, on the side of ram 280 distal to end cap 210. At the same time, gas within enclosure 227 will desirably be vented to atmosphere. This causes ram 280 to move towards end cap 210, in turn resetting ram 280 and bolt 290 for the next firing sequence. Consequently, ram 280 travels in a linear path, simply reciprocating in direction controlled by the relative pressures between enclosures 227, 237.

The high pressure gas flow is illustrated by arrows in FIG. 6, though the reference numerals described herein will be found on FIGS. 2-4. Volumizer 240, best visible in FIG. 3, includes three distinct sets of holes or ports through which the high pressure gas will pass. One set are the high pressure inlets 243, 245 to the volumizer core. While two holes are visible in the figures, it will be understood that in the preferred embodiment, three are used and that any suitable number may be used. These holes are placed between each of the flow ports 247-249. The exact number or size of high pressure inlets and flow ports are not critical to the operation of the invention, so long as there is an appropriate flow restriction induced by each for the appropriate function. These high pressure inlets 243, 245 extend through the volumizer body from exterior to interior, and permit high pressure gas to pass from the high pressure regulator into volumizer 240 enclosure 257. Like end cap 210 and low-pressure housing 220, volumizer 240 does not move with respect to gun body 120. Consequently, two O-rings 244, 246 are used to capture and isolate the high-pressure inlet to volumizer 240. As aforementioned, angularly displaced from each high-pressure inlet 243, 245, and thereby completely isolated therefrom, are a plurality of flow ports 247-249, best illustrated in FIG. 3. These flow ports 247-249 couple a flow path 258, labeled in FIG. 4 and formed between volumizer 240 wall 241 and gun body 120, through volumizer 240 wall to bolt 290. These flow ports 247-249 do not pass into the interior of the volumizer body, and instead only serve to port the high-pressure gas from the volumizer exterior flow path 258 to bolt 290.

In operation, volumizer 240 is filled in enclosure 257 with high-pressure gas passing from the high-pressure regulator through port 125 in gun body 120 to ports 243, 245 in volumizer 240, and from these ports into the volumizer enclosure 257. The filling of enclosure 257 may occur at any time, so long as volumizer enclosure 257 is fully pressurized prior to being discharged. Said another way, the size of ports 125, 243, 245, the pressure of the high-pressure source, and any other flow restrictions will control the amount of time needed to fully charge enclosure 257. Consequently, in the preferred embodiment an electrically controlled valve is used to initiate the charge of volumizer enclosure 257 sufficiently in advance of firing to reach full pressure. This may in one embodiment occur at the same time low-pressure gas is being introduced into port 225, though the timing may be different therefrom as desired or required.

Poppet valve 260 is initially closed, preventing escape of gas from volumizer enclosure 257. Consequently, the exterior of volumizer 240, defined by flow path 258, is at atmospheric pressure, being coupled from the barrel through bolt 290, and then through flow ports 247-249 formed in the volumizer wall that connect from bolt 290 to the volumizer wall 241 exterior. However, when poppet valve 260 is opened, high pressure gas accumulated within volumizer enclosure 257 will be discharged through poppet outlet 251 into the space between the volumizer and gun body 120 defined by flow path 258, which forms a passageway to the flow ports 247-249. As already noted, these ports 247-249 pass from the volumizer exterior of wall 241 to immediately adjacent bolt 290, all the while isolated within the wall of the volumizer from volumizer enclosure 257. Then the gas passes through holes 294 in the bolt into the firing chamber. One of these holes is visible in FIGS. 4-6 by cross-section, but the full plurality of holes 294 used in the preferred embodiment are best visible in FIG. 3.

The movement of ram 280 is used to drive bolt 290 forward past ball-retaining detent 126 and position paint ball 114 within the firing chamber, and simultaneously therewith, when bolt 290 is in proper position, to activate poppet valve 260. As aforementioned, the O-rings 291, 292 at either end of and circumscribing bolt 290 isolates the firing chamber from paint ball feed neck 110, thereby preventing any passage of high pressure gas into the paint ball inlet passage. Consequently, all components are operated upon a single longitudinal axis, in line with the gun barrel, through a single sliding ram 280.

In order to achieve this single-axis operation, poppet valve 260 has been located in the middle of valve assembly 200, between the low-pressure housing 220 and bolt 290. Such placement is in stark contrast to the prior art, where the poppet valve is placed at an end of the shaft and gun, and on a different axis from the barrel. The single-axis operation of the present invention is achieved by novel porting of the high pressure gas first into volumizer interior 257, and then around volumizer wall 241, using wall 241 to isolate flow ports 247-249 from the interior 257 of volumizer 240.

Poppet valve 260 encompasses ram 280. At the end of valve 260 adjacent enclosure 237, an internal O-ring 262 seals ram 280 and valve hammer surface 261, so that low-pressure or atmospheric pressure gas within enclosure 237 is isolated from either atmospheric or high-pressure gas found at the end of ram 280 adjacent to bolt 290. External O-ring 264 similarly isolates enclosure 237 from either atmospheric or high-pressure gas found within poppet outlet 251. Distal to valve hammer surface 261 is a spring 276 nested within volumizer cup 256. Cup 256 in the preferred embodiment is supported upon a cup support shaft 255 extending from the end of volumizer 240 adjacent to bolt 290, though the method of supporting cup 256 is not critical, and other suitable constructions or geometries may be used.

In order to best accelerate the travel of ram 280, friction will desirably be kept at a minimum. In order to reduce friction, a small amount of initial movement of ram 280 away from end cap 210 releases the seal between O-ring 260 and ram 280. This is enabled by the necked down region 289 in ram 280, which with very little motion is adjacent to O-ring 260 and so not frictionally engaged therewith.

Spring 276 generates separation forces between cup 256 and spring sleeve 274, which in turn presses against valve body 268. Valve body 268 most preferably has a small flare 269 extending from cylindrical core 270. Too large a flare will cause the surface area to be too great, and will consequently require the low pressure side undesirably be much closer in pressure to the high pressure source in order for the low-pressure ram 280 to generate more force than is being produced by the high pressure against valve body 268. In order to prevent leakage between valve body 268 and supporting cup 256, an O-ring seal 272 is provided.

When ram 280 is driven away from end cap 210, it slides relatively unrestricted through valve 260, only contacting therewith at O-ring 262, and even then only for a very short distance of travel.

Alignment of ram 280 while traveling is maintained through O-ring 284 engaging with low-pressure valve body 236 at the low-pressure end adjacent end cap 210, and through O-ring 291 engaging with gun body 120 adjacent in feed 110. Eventually, as illustrated in FIG. 5, top-hat shaped ram head 282 will be traveling at a relatively high rate of speed and will engage with valve hammer surface 261. This position illustrated in FIG. 5 is arrived at just prior to activation of valve 260.

Any further motion, which is not only assisted by the low-pressure generated force but also by the momentum of ram 280, will lead to movement of valve hammer surface 261 also away from end cap 210. The movement of valve hammer surface 261 will lead to translation of valve body 268 and spring sleeve 274 as well, in turn compressing sleeve 274. Most preferably, shoulder 238 against which O-ring 264 seats is sufficiently long along the axis of motion of ram 280 to ensure that the seal there between is maintained through the full movement of valve body 26.

As valve body 268 is moved away from valve seat 234, pressure is released from volumizer enclosure 257 into poppet outlet 251. This release of pressure removes the force which had existed on valve body 268 which was opposing movement of ram 280, leading to a sudden acceleration of both ram 280 and valve body 268. In this way, there is ensured a rapid discharge of the pressurized gas within volumizer enclosure 257. As the gas is discharged, it is passed through flow controlling surface 266, which is preferably shaped for more smooth and laminar flow of air to maintain the efficiency of flow and improve the paint ball velocity at a given operating pressure.

This high-pressure gas discharge position is illustrated in FIG. 6, and the flow of the high pressure gas is illustrated by the inlet stream 144 and the subsequent flow path already detailed herein above. As also shown in FIG. 6, the low-pressure inlet flow 142 is still open, maintaining the position of ram 280 against the force of spring 276. While spring 276 is not strictly required, the inclusion of this spring adds a certain amount of "pop" to the return motion of ram 280 after firing, due to the release of stored mechanical energy in the compression of spring 276. This "pop" or quick acceleration can occur more quickly than the initial building of gas pressure within enclosure 237, which pressure will preferably be timed to occur at such a time as to induce motion of both ram 280 and valve 260 back towards end cap 210, starting after the proper discharge of high pressure gas from within enclosure 257.

In accord with the teachings of the present invention, the preferred valve assembly 200 is manufactured as a number of discrete parts that are assembled into a single, modular component. The entire valve assembly 200 is held in place within gun body 120 by an anchoring screw passing through hole 214 in wing 212 into gun body 120. End cap 210 is rigidly coupled and aligned with low-pressure ram chamber 220 via one or more alignment pins 216 which are rigidly affixed to end cap 210 and which pass through an alignment hole formed in low-pressure ram chamber 220, as is visible in FIGS. 3-6. To securely fasten end cap 210 to low-pressure ram chamber 220, each alignment pin 216 is provided with a neck 217 into which a set screw 222 will engage. By proper shaping of neck 217, tightening of set screw 222 will draw end cap 210 tight against low-pressure ram chamber 220. Low-pressure ram chamber 220 couples with volumizer 240 through an external set of threads that thread into internally threaded volumizer flange 242. Finally, bolt 290 is threaded onto the threaded end 286 of ram 280.

A combination of as many relatively large holes 294 as possible and an extended bore 296 reduce the material and consequently the mass of bolt 290. Similarly, the diameter of ram 280 and total size of ram head 282 are kept to a minimum, likewise reducing the total mass. These reductions in mass reduce the time required to move ram 280 and bolt 290 in the reciprocal manner required for the operation of gun 100, thereby increasing the maximum attainable firing rate. In addition, the lower mass facilitates the ready handling and rapid movement of gun 100. In addition to the amounts of materials used being kept to a minimum, the selection of lighter and stronger materials will also enable reduced mass.

As a result of the preferred embodiment valve assembly 200, a gun may be manufactured and assembled in a very modular fashion. Further, since the preferred ram 280 is isolated from high pressures and the preferred poppet assembly is balanced, activation can be very rapid, a feature which is very desirable in modern paint ball guns.

While the preferred embodiment valve assembly 200 is inserted directly into a bore within gun body 120, it is also contemplated herein to provide a separate sleeve which serves the functions of gun body illustrated in FIGS. 4-6, which would in turn be mounted within a gun body. In either case, valve assembly 200 unifies the working components into a single, well controlled and readily replaced unit. This combined assembly not only simplifies gun maintenance and repair, but also reduces the space required for this combination of components into a single in-line assembly taking up no more space than a prior art bolt without valve.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A paintball gun, comprising a feed neck for receiving paint balls into a breech from an external source;

a barrel coupler for coupling to a gun barrel;

a source of high pressure gas coupled for distribution;

a human interface for manual initiation gun firing;

a gun body having a bore therein in line with said barrel coupler;

a valve assembly held within a bore in said gun body having an end cap, ram, low-pressure ram chamber, volumizer, valve, and bolt, said ram extending from adjacent said end cap to said bolt and coupled with said valve to activate said valve when driven away from said end cap, said ram passing inside of and coaxially through the center of said valve.

2. The paintball gun of claim 1, further comprising means for constraining said end cap, ram, low-pressure ram chamber, volumizer, valve, and bolt within said valve assembly, such that said valve assembly remains a single integrated unit not only during normal operation but also during removal from and insertion into said gun body.

3. The paintball gun of claim 1, wherein said valve assembly is in line with a barrel longitudinal axis.

4. The paintball gun of claim 1, wherein said human interface further comprises a handle and trigger for manual initiation gun firing.

* * * * *